US007730827B2

(12) United States Patent
Shimazaki et al.

(10) Patent No.: US 7,730,827 B2
(45) Date of Patent: Jun. 8, 2010

(54) ATTACHMENT STRUCTURE OF SWASH PLATE SUPPORT AND HYDRAULIC APPARATUS

(75) Inventors: Hirobumi Shimazaki, Kobe (JP); Ryosuke Kusumoto, Kobe (JP)

(73) Assignee: Kabushiki Kaisha Kawasaki Precision Machinery, Kobe-shi (JP)

( * ) Notice: Subject to any disclaimer, the term of this patent is extended or adjusted under 35 U.S.C. 154(b) by 372 days.

(21) Appl. No.: 11/989,050

(22) PCT Filed: Jul. 10, 2006

(86) PCT No.: PCT/JP2006/313680

§ 371 (c)(1),
(2), (4) Date: Jan. 18, 2008

(87) PCT Pub. No.: WO2007/010775

PCT Pub. Date: Jan. 25, 2007

(65) Prior Publication Data

US 2009/0304529 A1 Dec. 10, 2009

(30) Foreign Application Priority Data

Jul. 19, 2005 (JP) ..... 2005-208438

(51) Int. Cl.
*F03C 1/06* (2006.01)
*F04B 1/20* (2006.01)

(52) U.S. Cl. ..... 92/12.2; 92/128; 91/505

(58) Field of Classification Search ..... 92/12.2, 92/71, 128; 91/505
See application file for complete search history.

(56) References Cited

U.S. PATENT DOCUMENTS 4,884,952 A * 12/1989 Kanamaru et al. ..... 92/12.2
4,896,583 A * 1/1990 Lemke ..... 91/505
5,176,066 A * 1/1993 Kanamaru et al. ..... 91/499
6,405,634 B1 * 6/2002 Hansen ..... 92/71

FOREIGN PATENT DOCUMENTS

JP 59090782 5/1984
JP 2005-517126 6/2005

OTHER PUBLICATIONS

ISA Japanese Patent Office, International Search Report of PCT/JP2006/313680, Oct. 3, 2006, WIPO, 2 pages.

* cited by examiner

*Primary Examiner*—Thomas E Lazo
(74) *Attorney, Agent, or Firm*—Alleman Hall McCoy Russell & Tuttle LLP

(57) ABSTRACT

To provide an attachment structure of a swash plate support, that is, an attachment structure which suppresses an unstably fixed state of the swash plate support and realizes easy attachment and detachment of the swash plate support to and from a casing. A casing of a piston pump and a swash plate support which is attachable to the casing include a displacement preventing device and a rotation preventing device. In the swash plate support and the casing, since an engaging pawl portion of the displacement preventing device engages with an engaging portion, relative displacements in a first direction and a second direction along the rotational axis are prevented, and since a pin member of the rotation preventing device fits in the pin fit hole, relative rotations around the rotational axis are prevented.

5 Claims, 11 Drawing Sheets

ATTACHMENT STRUCTURE OF SWASH PLATE SUPPORT AND HYDRAULIC APPARATUS

TECHNICAL FIELD

The present invention relates to a hydraulic apparatus which can be suitably used as, for example, a piston pump using a swash plate or a piston motor using a swash plate, and particularly to an attachment structure of a swash plate support, that is, an attachment structure in which the swash plate support supporting the swash plate included in the hydraulic apparatus is attached to a casing of the hydraulic apparatus.

BACKGROUND ART

FIG. 10 is an enlarged cross-sectional view of a part of a piston pump 1 of a first prior art. The piston pump 1 includes, in a casing 2, a cylinder block which is rotatable in a rotational direction A1 around a rotational axis L1 by a rotational shaft 3. In the cylinder block, a plurality of piston chambers are formed, and cylinder ports connected to the piston chambers are formed. A piston fits in each piston chamber. Each piston is provided at a first end portion thereof with a shoe, and each shoe is pressed toward a swash plate 4 which inclines with respect to a virtual flat surface perpendicular to the rotational axis L1. In sync with the rotation of the cylinder block, each piston carries out a reciprocating displacement including an extending stroke and a retracting stroke.

The swash plate 4 is supported by a swash plate support 5 so as to be tiltable around a tilt axis L2 orthogonal to the rotational axis L1. A stroke length of each piston changes by tilting the swash plate around the tilt axis L2, and this changes the amount of hydraulic oil sucked into each piston chamber. In the casing 2, a pin 6 fits in an inner peripheral portion thereof. The pin 6 is provided such that a part thereof projects from the inner peripheral portion in a first direction along the rotational axis L1. The swash plate support 5 is attached to the casing 2 by causing the pin 6 to fit in the casing 2 in a state in which the rotational shaft 3 is inserted into the swash plate support 5. With this, the rotation of the swash plate support 5 around the rotational axis L1 is prevented. Thus, an angular displacement of the swash plate around the rotational axis L1 due to vibrations, etc. is prevented, and an unstably fixed state of the swash plate 4 is suppressed (Patent Document 1 for example).

FIG. 11 is an enlarged cross-sectional view of a part of a piston pump of a second prior art. A piston pump 10 includes a casing 11, a rotational shaft 12, a cylinder block, a plurality of pistons, a plurality of shoes, a swash plate 13 and a swash plate support 14, and is constructed in the same manner as the piston pump 1 of the first prior art. The swash plate support 14 is attached to the casing 11 in such a state that the rotational shaft 12 is inserted into the swash plate support 14. The swash plate support 14 is fastened to the casing 11 with a plurality of bolts 15 which penetrate through the casing 11 from its outer side to its inner side. With this, the rotation of the swash plate support 14 around the rotational axis L1 and the displacement of the swash plate support 14 in directions along the rotational axis L1 are prevented. Thus, the angular displacement of the swash plate around the rotational axis L1 due to vibrations, etc. and the displacement of the swash plate in the above directions caused by the displacement of the rotational shaft in the direction along the rotational axis L1 can be prevented, and the unstably fixed state of the swash plate is suppressed (See Japanese Laid-Open Patent Publication 59-90782 (page 2, FIG. 1))

DISCLOSURE OF THE INVENTION

Problems to be Solved by the Invention

In the piston pump 1 of the first prior art, although the relative rotation of the swash plate support 5 with respect to the casing 2 around the rotational axis L1 can be prevented by the pin 6, relative displacement in the directions along the rotational axis L1 may occur. Therefore, the unstably fixed state of the swash plate support 5 may occur by, for example, the displacement of the rotational shaft 3 in the directions along the rotational axis L1, and this unstably fixed state may cause problems, such as damaging of components provided in the casing, for example, a pressing member which presses the shoe against the swash plate 4.

In the piston pump 10 of the second prior art, to prevent the problems of the piston pump 1 of the first prior art, the rotation around the rotational axis L1 and the displacement in the directions along the rotational axis L1 can be prevented by the bolt 15. In the piston pump 10, since the casing and the swash plate support are fastened with the bolt 15, the bolt 15 is provided so as to penetrate through the casing 11. Therefore, the swash plate support 14 needs to be attached to the casing 11 in a state in which sealing is provided so that lubricating oil, etc. does not leak from a through hole through which the bolt 15 is inserted. On this account, an O ring 16 is provided. Since the O ring 16 needs to be provided in addition to the bolt 15, the number of components increases. In addition, since the bolt 15 is used, there is the trouble of having to attach and detach the swash plate support 14 to and from the casing 11.

An object of the present invention is to provide an attachment structure of a swash plate support, that is, an attachment structure which can suppress the unstably fixed state of the swash plate support around the rotational axis and in the axial directions, and in which the swash plate support can be easily attached to the casing.

Device for Solving the Problems

The present invention is an attachment structure of a swash plate support, comprising (a) a casing accommodating: a cylinder block which is provided so as to be rotatable around a rotational axis and includes a plurality of piston chambers in which a plurality of pistons which extend and retract in accordance with a rotation of the cylinder block fit; and a swash plate which supports the pistons, (b) the swash plate support which is provided on the casing so as to be rotatable around the rotational axis between an attachment preparing position and an attachment completing position, for supporting the swash plate at the attachment completing position, and (c) an axial direction displacement preventing device for, in a state where the swash plate support is placed at the attachment preparing position, allowing the swash plate support to be displaced with respect to the casing in an axial direction along the rotational axis, and in a state where the swash plate support is placed at the attachment completing position, preventing the swash plate support from being displaced with respect to the casing in the axial direction along the rotational axis.

Moreover, in the present invention, the axial direction displacement preventing device includes: a first engaging portion provided on the casing; and a second engaging portion which is provided on the swash plate support, does not engage with the first engaging portion in a state where the swash plate support is placed at the attachment preparing position, and engages with the first engaging portion in a state where the swash plate support is placed at the attachment completing position.

Moreover, the present invention further comprises a rotation preventing device for, in a state where the swash plate support is placed at the attachment completing position, preventing the swash plate support from rotating around the rotational axis with respect to the casing.

Moreover, in the present invention, the rotation preventing device includes: an engagement hole provided on one of the casing and the swash plate support; a pin member which is provided on the other of the casing and the swash plate support, and is displaceable between a non-engagement position where the pin member does not engage with the engagement hole and an engagement position where the pin member engages with the engagement hole in a state where the swash plate support is placed at the attachment completing position; and a spring force generating device for elastically pressing the pin member in an engagement direction that is a direction from the non-engagement position to the engagement position.

The present invention is a hydraulic apparatus using the above-described attachment structure.

EFFECTS OF THE INVENTION

In accordance with the present invention, the swash plate support can be rotated with respect to the casing from the attachment preparing position to the attachment completing position around the rotational axis. The swash plate support placed at the attachment preparing position can be displaced with respect to the casing in an axial direction along the rotational axis. The swash plate support placed at the attachment completing position supports the swash plate, is prevented from being displaced with respect to the casing in the axial direction along the rotational axis by the axial direction displacement preventing device, and is attached to the casing. Therefore, when the swash plate support is rotated so as to be placed at the attachment completing position, the unstably fixed state (problem of the first prior art) of the swash plate support with respect to the casing in the axial direction, for example, unstably fixed state in the axial direction due to vibrations and contacts of a drive shaft, is suppressed. Thus, the occurrence of problems, such as damages to internal parts, due to the unstably fixed state of the swash plate support with respect to the casing is suppressed. Moreover, only by causing the swash plate support to rotate from the attachment preparing position to the attachment completing position, the swash plate support can be attached to the casing, and only by causing the swash plate support to rotate from the attachment completing position to the attachment preparing position, the swash plate support can be set to be detachable from the casing. Therefore, the swash plate support can be attached to and detached from the casing more easily than the second prior art. Further, unlike the second prior art, it is not necessary to cause the bolt to penetrate through the casing, and the leakage of oil from a portion where a fitting structure is applied is prevented without adopting a sealing structure.

In accordance with the present invention, the first engaging portion provided on the casing can engage with the second engaging portion provided on the swash plate support. In the state where the swash plate support is placed at the attachment preparing position, the second engaging portion does not engage with the first engaging portion, so that the first engaging portion can be detached from the second engaging portion. In the state where the swash plate support is placed at the attachment completing position, the second engaging portion engages with the first engaging portion, so that the swash plate support is prevented from being displaced with respect to the casing in the axial direction along the rotational axis. With this, it is possible to realize such an attachment structure of the swash plate support that the unstably fixed state of the swash plate support with respect to the casing in the axial direction can be suppressed, and the swash plate support can be attached to the casing by a simple operation of causing the swash plate support to rotate around the rotational axis.

In accordance with the present invention, in the state where the swash plate support is placed at the attachment completing position, the swash plate support is attached to the casing so as to be prevented by the rotation preventing device from being rotated with respect to the casing around the rotational axis. Therefore, when the swash plate support is rotated so as to be placed at the attachment completing position and attached to the casing, the unstably fixed state of the swash plate support with respect to the casing around the rotational axis, for example, unstably fixed state around the rotational axis due to vibrations, is suppressed. Thus, the occurrence of problems, such as damages to internal parts, due to the unstably fixed state of the swash plate support with respect to the casing is suppressed. Moreover, only by causing the swash plate support to rotate from the attachment preparing position to the attachment completing position, the swash plate support can be attached to the casing, and only by causing the swash plate support to rotate from the attachment completing position to the attachment preparing position, the swash plate support can be set to be detachable from the casing. Therefore, the swash plate support can be attached to and detached from the casing more easily than the second prior art. With this, it is possible to facilitate the attaching and detaching of the swash plate support, that is, avoid the trouble of having to attach and detach the swash plate support, and suppress the unstably fixed state.

In accordance with the present invention, the engagement hole provided on one of the casing and the swash plate support can engage with the pin member provided on another of the casing and the swash plate support. In the state where the swash plate support is placed at the attachment completing position, the pin member can be displaced between the non-engagement position where the pin member does not engage with the first engaging portion and the engagement position where the pin member engages with the first engaging portion. Therefore, by causing the pin member to be displaced so as to be placed at the engagement position, the displacement of the swash plate support with respect to the casing around the rotational axis is prevented, and by causing the pin member to be displaced so as to be placed at the non-engagement position, the displacement of the swash plate support with respect to the casing around the rotational axis is allowed. With this, it is possible to realize such an attachment structure of the swash plate support that the unstably fixed state of the swash plate support with respect to the casing around the rotational axis can be suppressed, and the swash plate support can be easily attached to the casing by a simple operation of causing the swash plate support to rotate around the rotational axis. Moreover, by causing the pin member to engage with the engagement hole, the positioning of the swash plate support with respect to the casing can be carried out.

Moreover, in the present invention, the pin member is elastically pressed by the spring force generating device in an engagement direction that is a direction from the non-engagement position to the engagement position. Therefore, in the state where the swash plate support is placed at the attachment completing position, the pin member is elastically pressed so as to be displaced from the non-engagement position to the engagement position, and realizes engagement. Thus, only by causing the swash plate support to be displaced so as to be placed at the attachment completing position, the pin member can engage with the engagement hole, and the swash plate support can be easily attached to the casing. Moreover, since the pin member is elastically pressed in the engagement direction, the withdrawing of the pin member from the engagement position to the non-engagement position is prevented, and the displacing of the swash plate support from the attachment completing position to the attachment preparing position is prevented. Therefore, the displacements of the swash plate support with respect to the casing in the axial direction and around the rotational axis are prevented, and the unstably fixed state is suppressed surely. Moreover, by pressing the pin member, placed at the engagement position, in a direction opposite the engagement direction, the pin member can be displaced from the engagement position to the non-engagement position. With this, the swash plate support can be displaced from the attachment completing position to the attachment preparing position, and the swash plate support can be set to be detachable. Thus, it is possible to change from a state in which the swash plate support is attached to the casing to a state in which the swash plate support is easily detachable. With this, it is possible to facilitate the attaching and detaching of the swash plate support, that is, avoid the trouble of having to attach and detach the swash plate support, and suppress the unstably fixed state.

In accordance with the present invention, the attachment structure of the swash plate support is used in a hydraulic apparatus. With this, it is possible to realize the hydraulic apparatus in which the unstably fixed state of the swash plate support is suppressed.

BRIEF DESCRIPTION OF THE DRAWINGS

FIG. 9(1) is a view showing that the pin member 67 does not yet fit in the pin fit hole 73, and FIG. 9(2) is a view showing that the pin member 67 has fitted in the pin fit hole 73.

EXPLANATION OF REFERENCE NUMBERS

Figure 1:
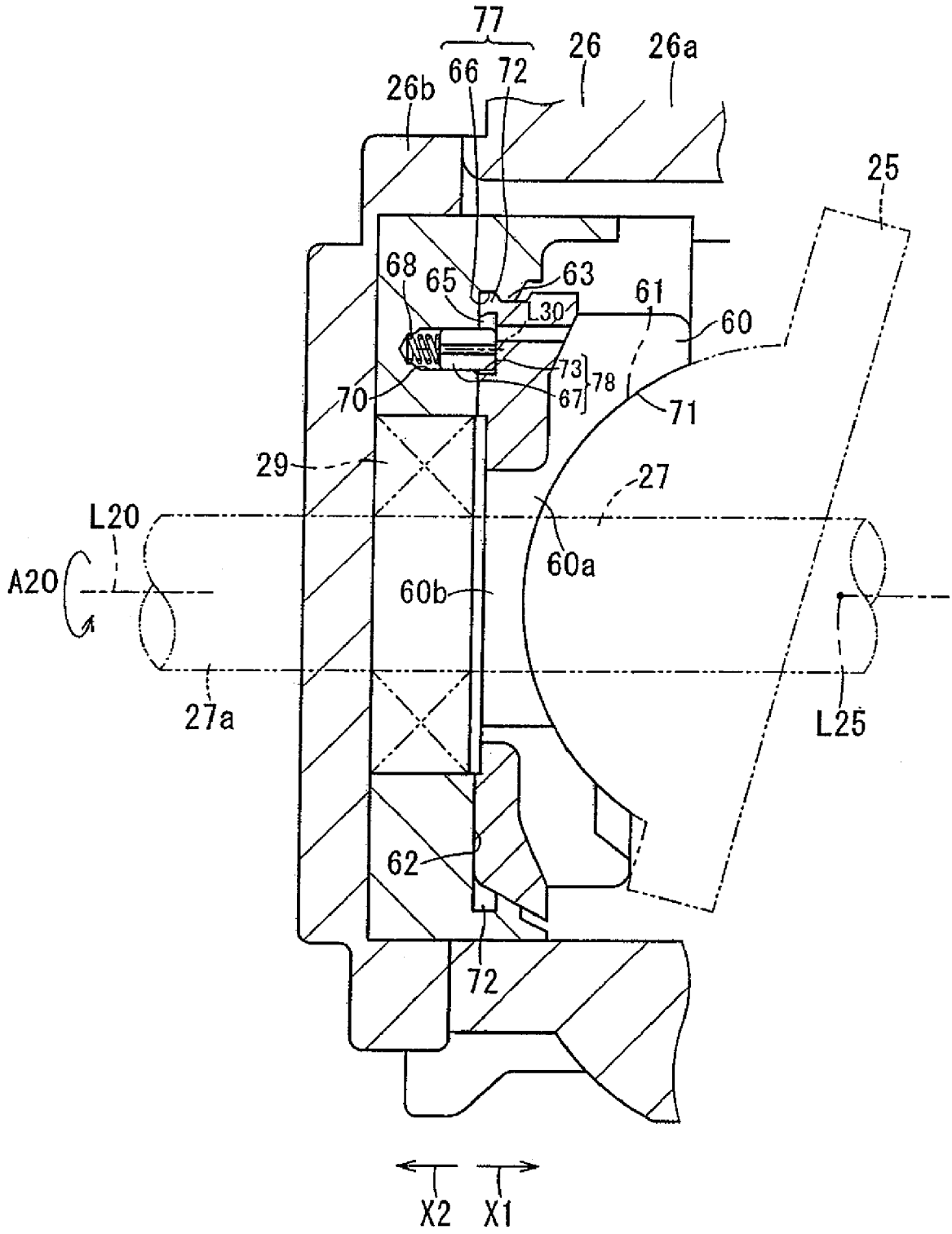
FIG. 1 is a cross-sectional view showing a portion of a piston pump 20 using an attachment structure of a swash plate support 60 according to a first embodiment of the present invention.

20 piston pump
22 cylinder block
23 piston
25 swash plate
26 casing
26*c* front cover
60 swash plate support
63 engaging portion
67 pin member
68 elastic member
72 engaging pawl portion
73 pin fit hole

BEST MODE FOR CARRYING OUT THE INVENTION

Now, several embodiments for carrying out the present invention will be described with reference to the drawings. Throughout the embodiments, the same reference numbers are used to identify corresponding components which have been already described in a preceding embodiment and therefore will not be described repetitively. When only a part of the components is described, it is described on the premise that the other parts are the same as those previously described. In addition to the combination described in each embodiment, the embodiments may be partially combined so long as that partial combination does not particularly cause any problems.

Figure 2:
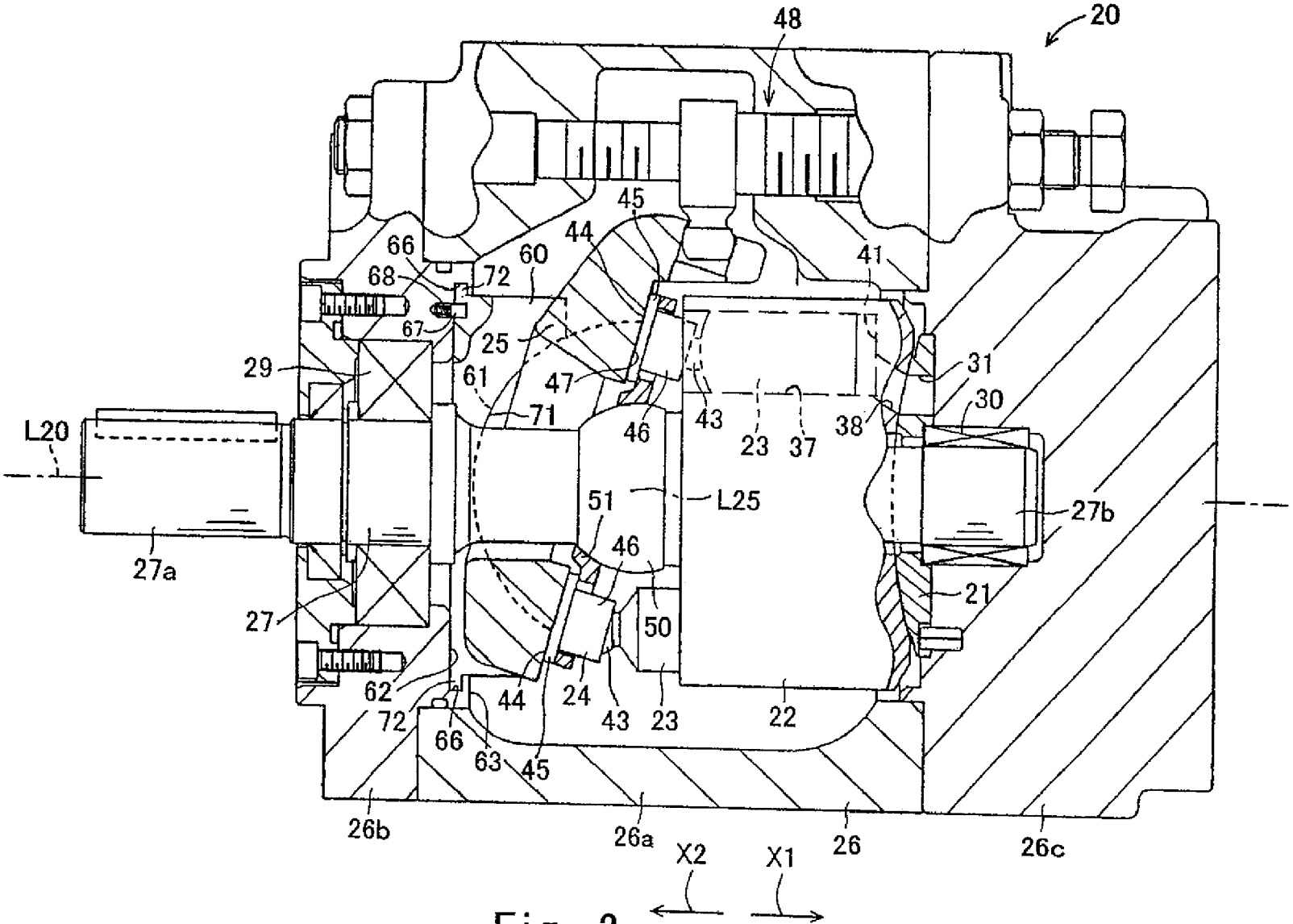
FIG. 2 is a cross-sectional view schematically showing the piston pump 20.
Figure 3:
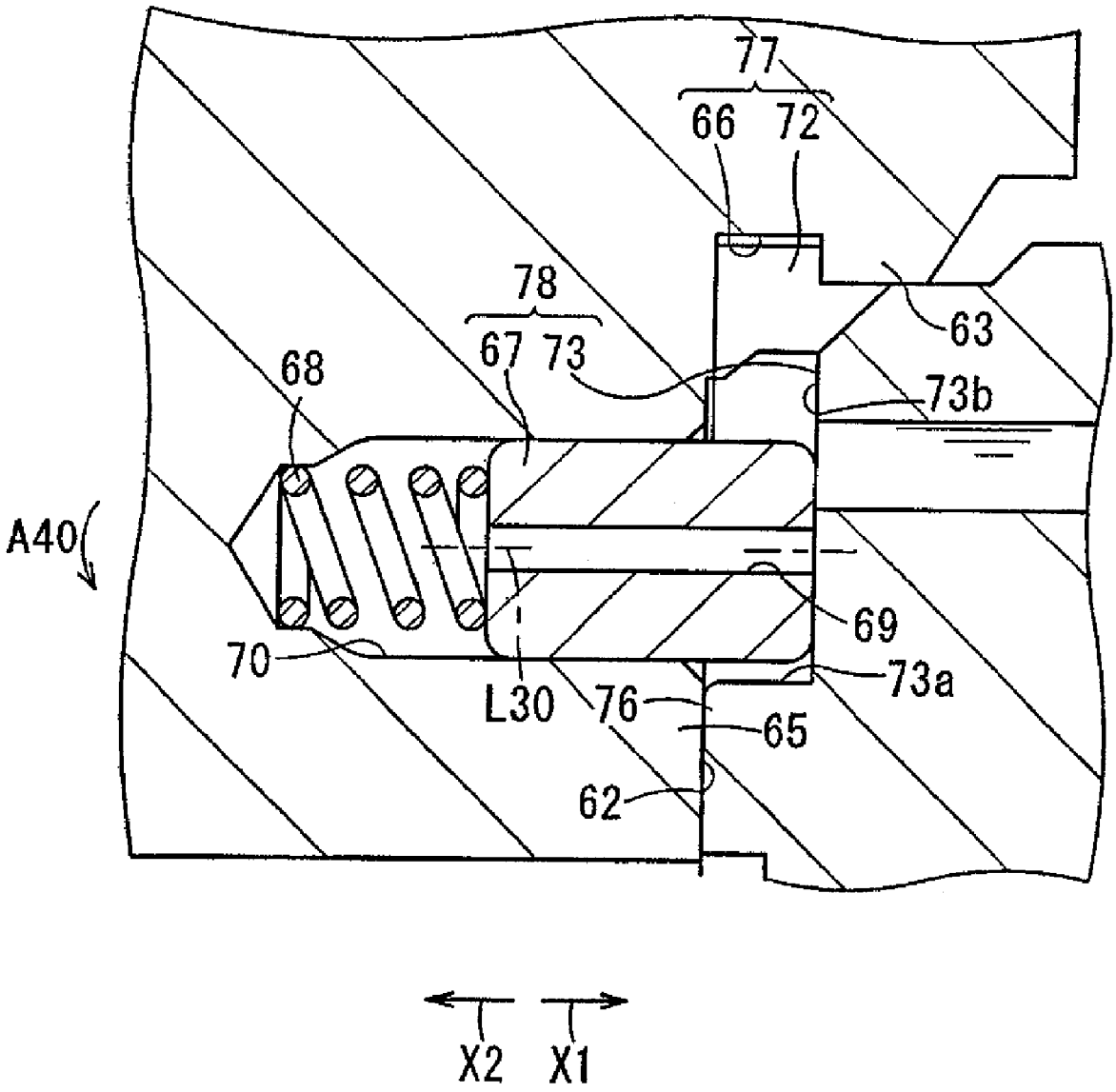
FIG. 3 is an enlarged cross-sectional view of the portion of the piston pump 20 using the attachment structure of the swash plate support 60.

FIG. 1 is a cross-sectional view showing a portion of a piston pump 20 using an attachment structure of a swash plate support (base) 60 according to a first embodiment of the present invention. FIG. 2 is a cross-sectional view schematically showing the piston pump 20. FIG. 3 is an enlarged cross-sectional view of the portion using the attachment structure of the swash plate support 60. The piston pump 20 that is a hydraulic apparatus is, for example, a variable displacement swash plate type hydraulic pump provided in industrial machinery and construction machinery. The piston pump 20 is driven by a driving force applied from generating machinery. The piston pump 20 is used to drive an actuator provided in industrial machinery and construction machinery, by supplying a hydraulic oil that is a hydraulic fluid to the actuator. The piston pump 20 basically includes a valve plate 21, a cylinder block 22, a plurality of pistons 23, a plurality of shoes 24, a swash plate 25 and a swash plate support 60. These are stored in a casing 26 further included in the piston pump 20. The casing 26 includes a casing body 26*a*, a front cover 26*b* and a valve casing 26*c*.

The piston pump 20 further includes a rotational shaft 27. The rotational shaft 27 is supported by a front cover 26*b* via a first bearing 29 so as to be rotatable around a rotational axis L20, which coincides with the axis of the rotational shaft 27, such that a first axial end 27*a* of the rotational shaft 27 partially projects from the front cover 26*b*. Moreover, a second axial end 27*b* of the rotational shaft 27 is supported by the valve casing 26*c* via a second bearing 30 such that the rotational shaft 27 is rotatable around the rotational axis L20. The rotational shaft 27 is rotatable in a rotational direction A20.

The valve plate 21 has substantially a disc shape, is provided coaxially with the rotational shaft 27 with the rotational shaft 27 inserted thereinto, and is fastened to the valve casing 26*c*. The valve plate 21 includes an inlet port 31 and an outlet port (not shown). The inlet port 31 and the outlet port are respectively formed at positions shifting from each other at about 180 degrees around the rotational axis L20 such that each port has an arc shape extending in a circumferential direction. For easier comprehension, FIG. 2 shows that the position of the inlet port 31 shifts in the circumferential direction.

The cylinder block 22 is provided on the rotational shaft 27 such that the rotational shaft 27 is coaxially inserted thereinto, and mutual rotations are prevented by, for example, being splined to each other. The cylinder block 22 is rotatable around the rotational axis L20. Further, the cylinder block 22 includes a plurality of piston chambers 37 arranged at equal intervals in the circumferential direction, and further includes cylinder ports 38 which are respectively connected to the piston chambers 37 and arranged at equal intervals in the circumferential direction. Each piston chamber 37 has an axis substantially in parallel with the rotational axis L20, and opens at a first axial end of the cylinder block 22. Each cylinder port 38 opens at a second axial end of the cylinder block 22. The cylinder block 22 is provided such that the second axial end contacts the valve plate 21 so as to be sealed therebetween and be slidable against each other. Depending on an angular position of the cylinder block 22, each cylinder port 38 is connected to the inlet port 31 or the outlet port.

Each piston 23 has substantially a cylindrical shape, is stored in the piston chamber 37 of the cylinder block 22 so as to be sealed therebetween and partially fit therein, and forms a hydraulic chamber 41. Moreover, the piston 23 is provided so as to be able to carry out a reciprocating displacement along its axis with respect to the cylinder block 22. The reciprocating displacement of the piston 23 includes an extending stroke that is a displacement in an extending direction and a retracting stroke that is a displacement in a retracting direction. The capacity of the hydraulic chamber 41 changes according to the displacement of the each piston 23. Moreover, an outer surface of a first axial end 43 of each piston 23, which end 43 projects from the piston chamber 37, has a spherical shape.

Each shoe 24 has substantially a cylindrical shape, and includes, at its first axial end, a flange portion 45 having a contact surface 44 perpendicular to the axis and further includes a fitting portion 46 which opens at its second axial end. An inner surface of the fitting portion 46 of the shoe 24 has a spherical shape. With the first axial end 33 of the piston 23 fitted in the fitting portion 46, the shoes 24 are connected to the pistons 23 so as to be rotatable individually and in combination around three orthogonal axes around the centers of the fitting portion 46 and the first axial end 43 as rotational centers.

The swash plate 25 is provided on a side of the first axial end of the cylinder block 22, and includes a flat supporting surface 47 which receives and supports the contact surface 44 of the shoe 24. The swash plate 25 includes a tilting surface 61, having a partially cylindrical surface shape, on an opposite side of the supporting surface 47. The swash plate 25 is provided so as to be tiltable around a tilt axis (in the present embodiment, a tilt axis L25 orthogonal to the rotational axis L20) extending in a direction different from the rotational axis L20. The swash plate 25 is driven by a servo mechanism 48, included in the piston pump 20, so as to tilt around the tilt axis L25, so that the angle of the supporting surface 47 with respect to the rotational axis L20 changes. By changing the above angle, the swash plate 25 displaces the shoes 24, and changes the stroke lengths of the pistons 23. The servo mechanism 48 is provided, for example, at an upper portion of the casing 26.

The piston pump 20 further includes pressing members 51. The rotational shaft 27 is provided with a spherical bush 50, whose outer surface has a spherical shape, at a portion closer to the first axial end 27*a* than the cylinder block 22. The center of the sphere formed by the outer surface of the spherical bush 50 coincides with one point (in the present embodiment, an intersection point of the rotational axis L20 and the tilt axis L25) on the rotational axis L20, and the outer surface of the spherical bush 50 serves as a guiding surface which guides the pressing members 51.

The pressing members 51 are provided so as to be rotatable independently and in combination around three orthogonal axes around the center (that is, the intersection point of the rotational axis L20 and the tilt axis L25) of the sphere formed by the guiding surface as the rotational center in a state in which the pressing members 51 are supported by the guiding surface of the spherical bush 50. The pressing member 51 engages with the flange portion 45 of the shoe 24 and presses the shoe 24 toward the supporting surface 47 of the swash plate 25. In this state, the shoe 24 is allowed to be displaced slightly with respect to the pressing member 51 in a direction along the supporting surface 47 of the swash plate 25.

The piston pump 20 is constructed so that the piston 23 reciprocates once when the cylinder block 22 rotates once. The reciprocating movement of the piston 23 includes a most extended position where the piston 23 extends most and a most retracted position where the piston 23 retracts most, and these positions are angular positions shifting from each other at 180 degrees in the circumferential direction around the rotational axis L20. Specifically, the most extended position and the most retracted position exist at angular positions at which the axis of the piston meets a virtual plane that includes the rotational axis L20 and is perpendicular to the tilt axis L25. Regarding the reciprocating displacement of the piston 23, a stroke from the most extended position toward the most retracted position is the retracting stroke, and a stroke from the most retracted position toward the most extended position is the extending stroke. Hereinafter, the most extended position and the most retracted position may be referred to as "dead center".

Figure 4:
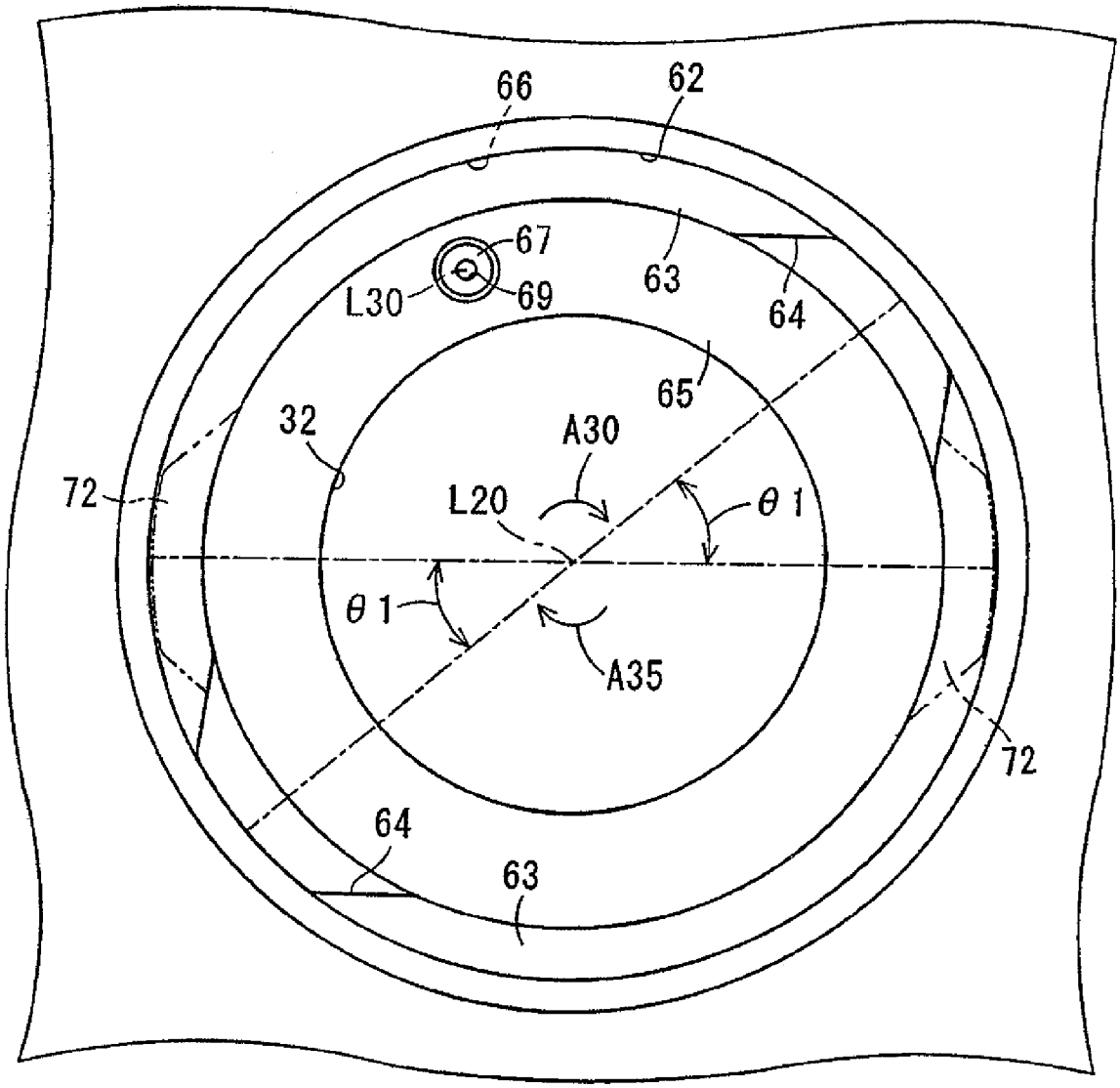
FIG. 4 is a front view showing a part of a front cover 26*b*.

FIG. 4 is a front view showing a part of a front cover 26*b*. Explanations will be made with reference to FIGS. 1 to 3. The front cover 26*b* includes, around the rotational axis L20, an attachment hole 62 which is larger in diameter than a hole 32 in which the first bearing 29 fits. The front cover 26*b* includes a plurality of engaging portions 63 which are provided on an inner peripheral portion forming the attachment hole 62 so as to project radially inwardly. The engaging portions 63 that are first engaging portions are formed so as to be spaced apart from each other in the circumferential direction, and an insertion opening 64 is formed between adjacent engaging portions 63. In the present embodiment, a pair of engaging portions 63 are formed entirely on the inner peripheral portion in the entire circumferential direction except for two insertion openings 64, and these insertion openings 64 are formed at positions shifting from each other at 180 degrees in the circumferential direction. Respective engaging portions 63 and a bottom portion 65 forming the attachment hole 62 form an engaging groove portion 66 which opens radially inwardly.

The casing 26 further includes a pin member 67 and an elastic member 68. The pin member 67 is a parallel pin, having a cylindrical shape, in which an air hole 69 is formed around a center axis L30 thereof. The pin member 67 is provided so as to fit in the bottom portion 65 of the front cover slidably in a first direction X1 and a second direction X2 of the rotational axis L20 that are axial directions along the rotational axis L25 (hereinafter may be simply referred to as "X1 direction" and "X2 direction"). Note that the pin member 67 is not limited to the member having the air hole 69, but may be a member not having the air hole 69. The pin member 67 is provided, for example, on an upper portion side of the bottom portion 65. Note that the position of the pin member 67 is not limited to the upper portion side of the bottom portion 65, but the pin member 67 may be provided on a lower portion side of the bottom portion 65. An elastic member accommodating space 70 is formed between the pin member 67 and the bottom portion 65. The elastic member accommodating space 70 accommodates an elastic member 68 (in the present embodiment, a compression coil spring member) which applies an elastic force, in the X1 direction that is the engagement direction, to the pin member 67. The pin member 67 in a natural state partially projects in the X1 direction by the force applied from the elastic member 68 that is a spring force generating device. The air hole 69 is formed to release air in the elastic member accommodating space 70 when the pin member 67 slides.

Figure 5:
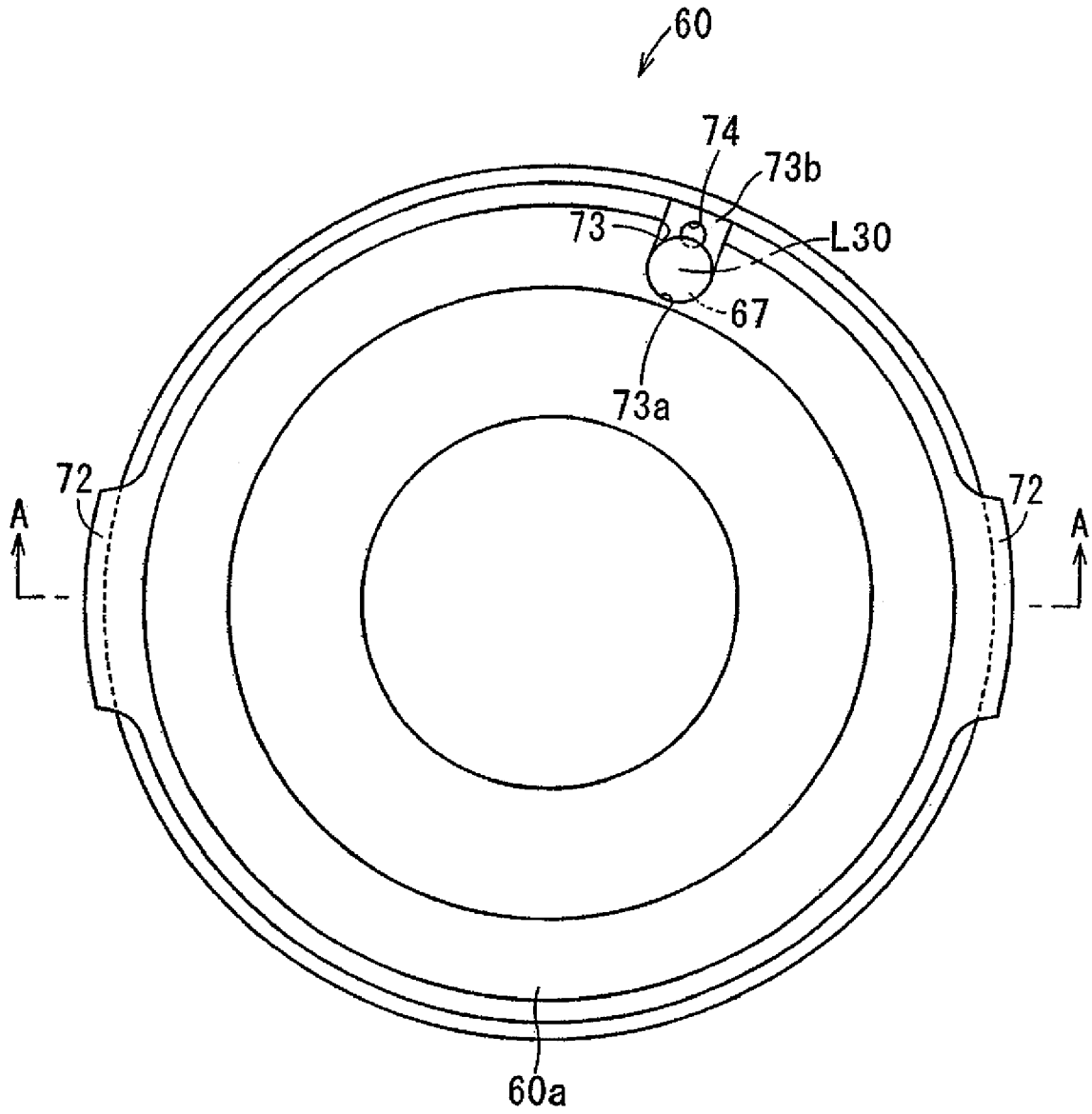
FIG. 5 is a front view showing the swash plate support 60.
Figure 6:
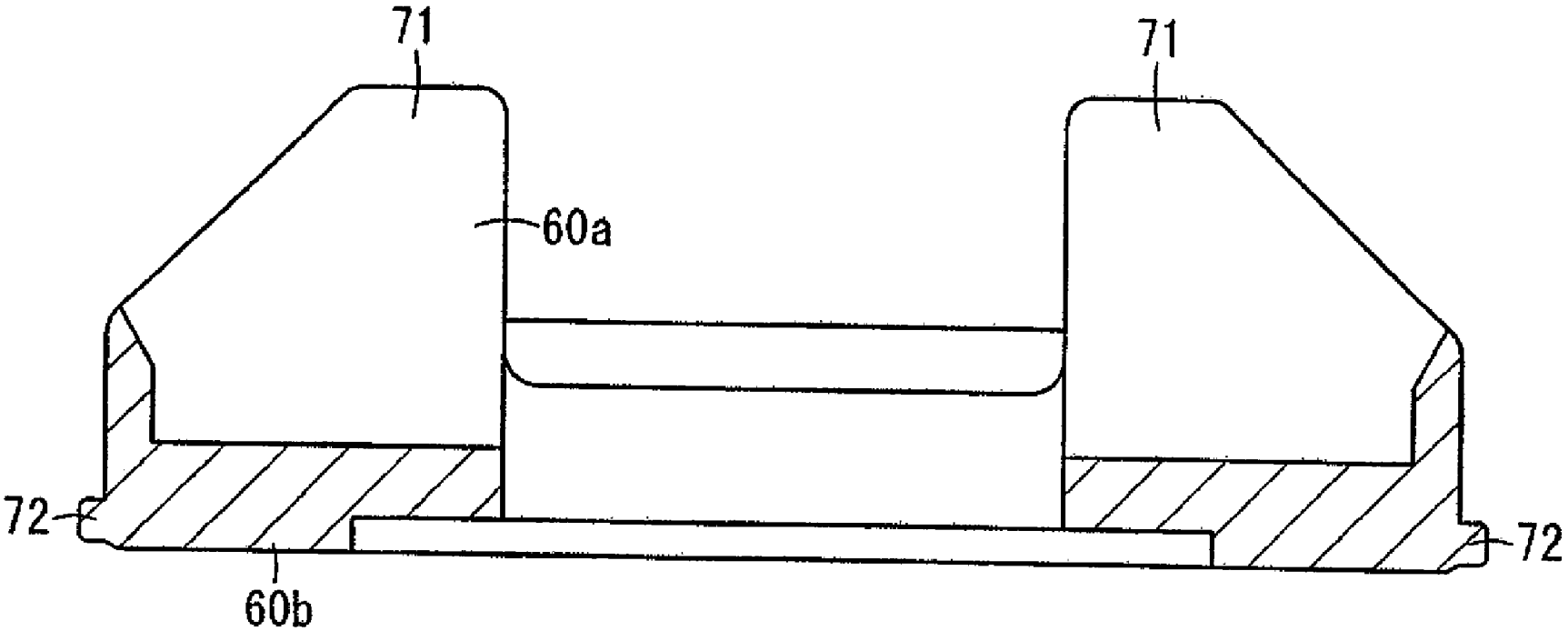
FIG. 6 is a cross-sectional view taken along line A-A of the swash plate support 60.
Figure 7:
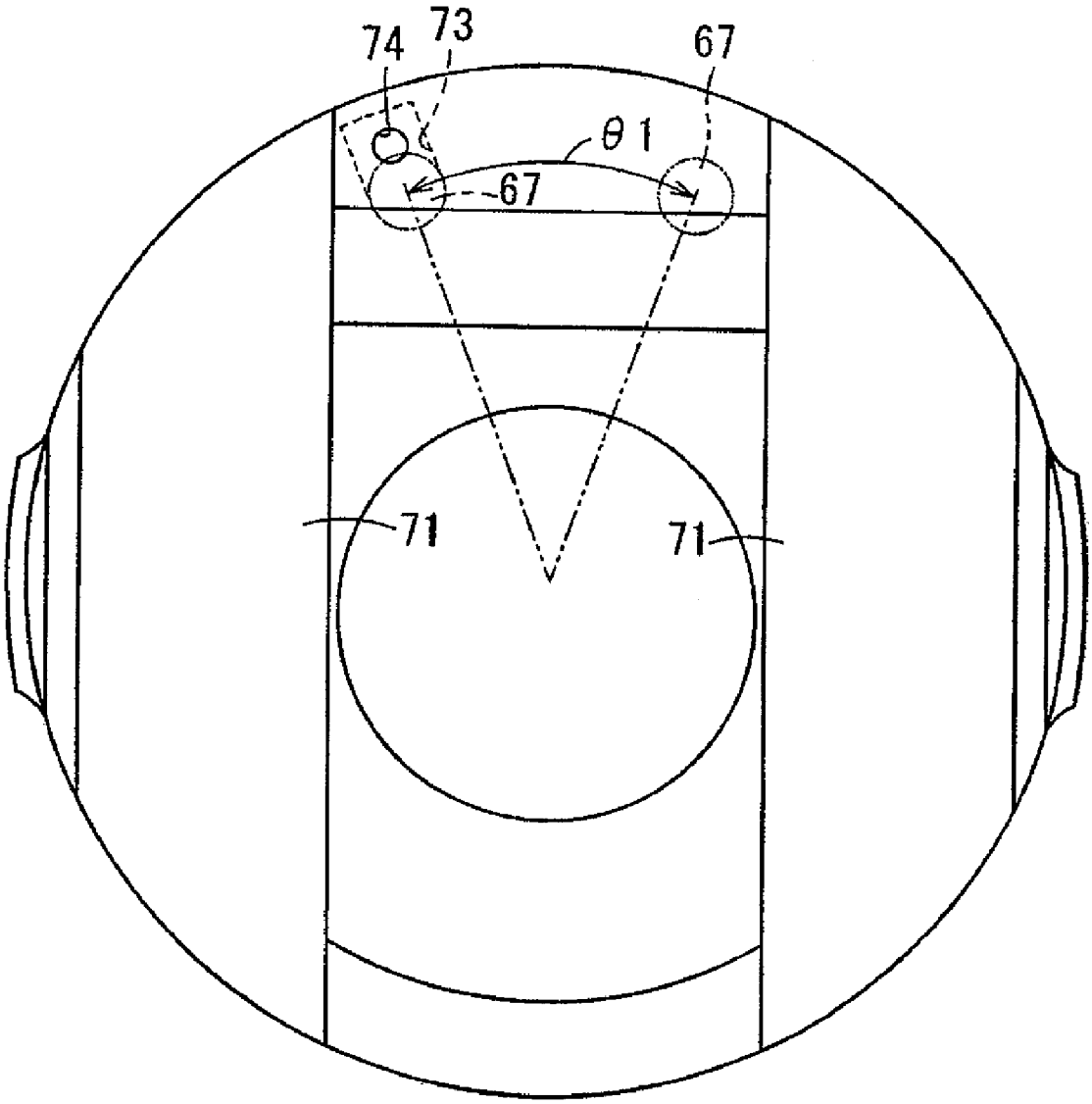
FIG. 7 is a rear view showing the swash plate support 60.

FIG. 5 is a front view showing the swash plate support 60. FIG. 6 is a cross-sectional view taken along line A-A of the swash plate support 60. FIG. 7 is a rear view showing the swash plate support 60. The swash plate support 60 has substantially a disc shape and is provided in the casing 26 so as to be attached to the attachment hole 62. The swash plate support 60 is provided so as to be rotatable, while being attached to the attachment hole 62, around the axis of the attachment hole 62 which coincides with the rotational axis L20. A first axial surface portion 60*a* of the swash plate support 60 includes a pair of swash plate supporting surfaces 71, having a partially cylindrical surface shape, which receive and support the tilting surface 61 of the swash plate 25 so that the swash plate 25 is tiltable around the tilt axis L25. In the present embodiment, the pair of swash plate supporting surfaces 71 are formed so as to be spaced apart from each other in a direction along the tilt axis L25. A plurality of engaging pawl portions 72 are formed at a second axial surface portion 60*b* side of an outer peripheral portion of the swash plate support 60 so as to project radially outwardly. In FIGS. 1 to 3, for easier comprehension, the engaging pawl portions 72 are shown at positions shifting from positions shown in FIG. 5 in the circumferential direction. The engaging pawl portions 72 that are second engaging portions are formed so as to be spaced apart from each other in the circumferential direction and be able to be respectively inserted from the insertion openings 64. Further, the engaging pawl portion 72 is formed so that, when the engaging pawl portion 72 is inserted from the insertion opening 64 and is rotated in a first circumferential direction A30 in a state in which a contact surface portion 60*b* that is the second axial surface portion 60*b* is in contact with the bottom portion 65, at least a part of the engaging pawl portion 72 fits in the engaging groove portion 66 and engages with the engaging portion 63, and when the engaging pawl portion 72 is rotated in a second circumferential direction A35 in an engaged state, it is brought out of engagement. As shown in FIG. 4, the first circumferential direction A30 is a clockwise direction, and the second circumferential direction A35 is an anticlockwise direction. The engaging portion 63 is formed so as to realize engagement in a state in which the swash plate support 60 is attached to the attachment hole 62 in such a manner that at least a part of the engaging pawl portion 72 fits in the engaging groove portion 66 to prevent the rotation in the circumferential direction. Desirably, as in the present embodiment, the engaging portion 63 is formed so as to realize engagement in a state in which the entire engaging pawl portion 72 fits in the engaging groove portion 66 to prevent the displacements in the X1 direction and the X2 direction. In the present embodiment, a pair of engaging pawl portions 72 are formed at positions shifting from each other at 180 degrees in the circumferential direction.

Figure 8:
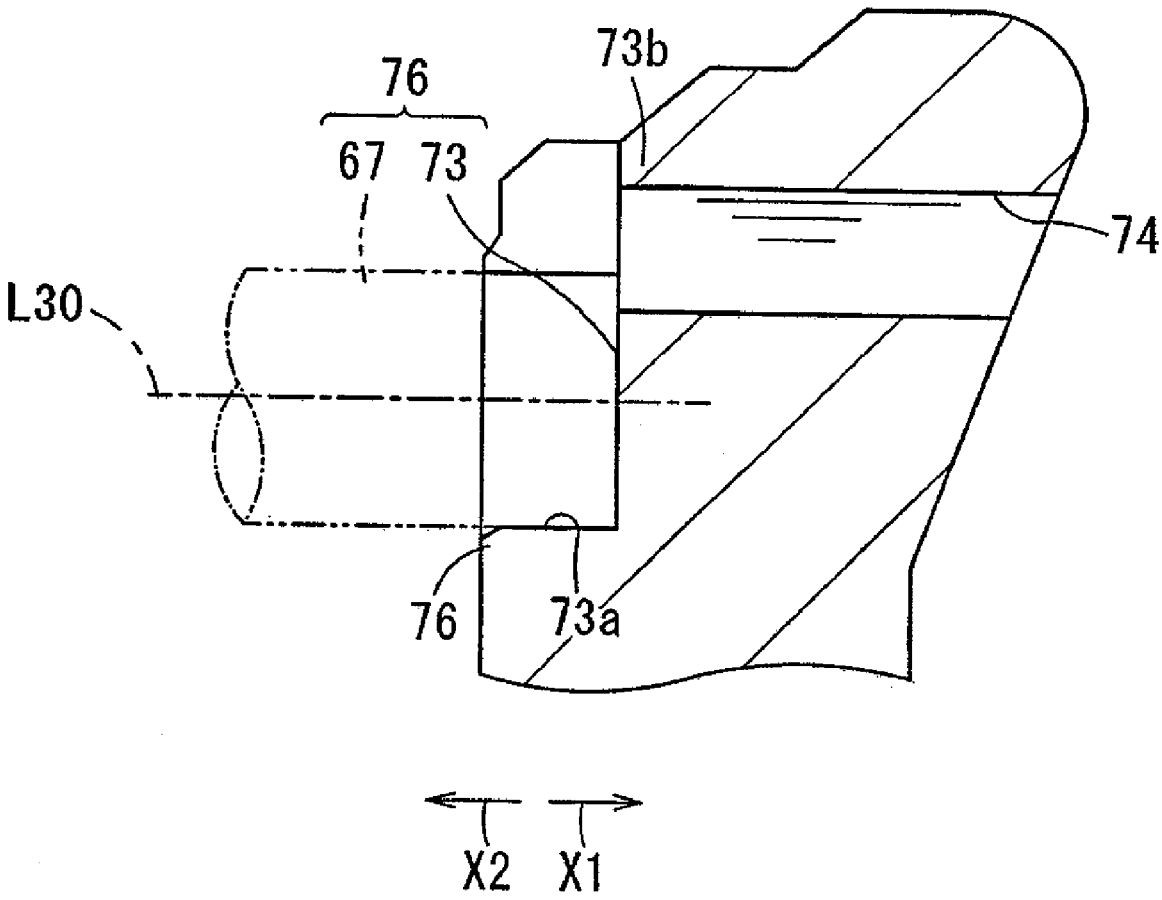
FIG. 8 is an enlarged cross-sectional view of a pin fit hole 73.

FIG. 8 is an enlarged cross-sectional view of a pin fit hole 73. The swash plate support 60 includes, on the contact surface portion 60*b*, the pin fit hole 73 in which the pin member 67 attached to the attachment hole 62 in a natural state can fit. The pin fit hole 73 that is an engagement hole extends in a radial direction of the swash plate support 60 and opens radially outward, and a portion of the pin fit hole 73 on the radially inward side has a semi-cylindrical shape. The pin member 67 in a natural state fits, without the unstably fixed state, in this semi-cylindrical-shape portion such that the center axis L30 coincides with an axis of the semi-cylindrical-shape portion.

A bottom portion 73*b* of the pin fit hole 73 has a through hole 74 which passes through the swash plate support 60 substantially in parallel with the axis of the swash plate support 60 and opens at the first axial surface portion 60*a* and second surface portion 60*b* of the swash plate support 60. The through hole 74 is formed closer to the radially outward side of the swash plate support 60 than the center axis of the semi-cylindrical-shape portion of the pin fit hole 73, that is, than the center axis L30 of the pin member 67 to fit. The through hole 74 is formed such that, in a state where the pin member 67 fits therein, at least a part of a first axial end of the pin member 67 faces the through hole 74. The through hole 74 is provided so as to allow a straight rod member to be inserted thereto to apply, to the pin member 67, a force against the elastic force of the elastic member 68, and is formed such that the pin member 67 is pushed back by the application of the force and can withdraw from the pin fit hole 73. In the present embodiment, the through hole 74 is formed around an axis substantially in parallel with the axis of the swash plate support 60 so as to open at a position shifting from the center axis of the pin member 67 which fits in the pin fit hole 73 such that the opening does not entirely face the air hole 69.

In the piston pump of the present embodiment, the engaging pawl portion 72 and the engaging portion 63 correspond to an axial direction displacement preventing device 77, and the pin member 67 and the pin fit hole 73 correspond to a rotation preventing device 78.

Figure 9:
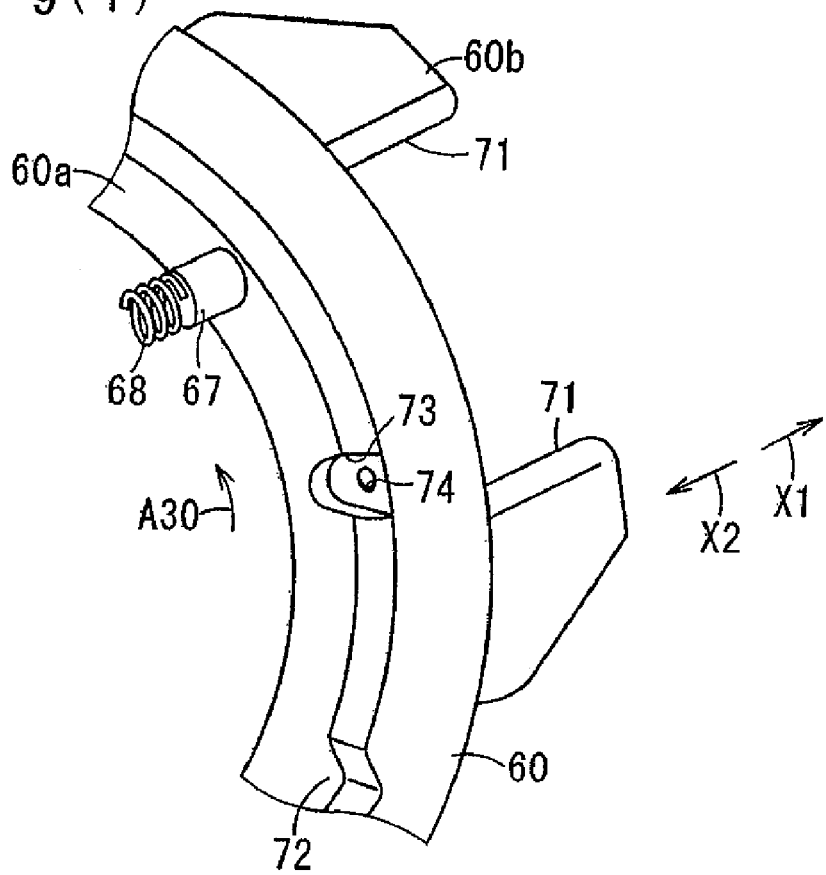
FIG. 9 shows views for explaining a process of fitting a pin member 67 in the pin fit hole 73.
Figure 9:
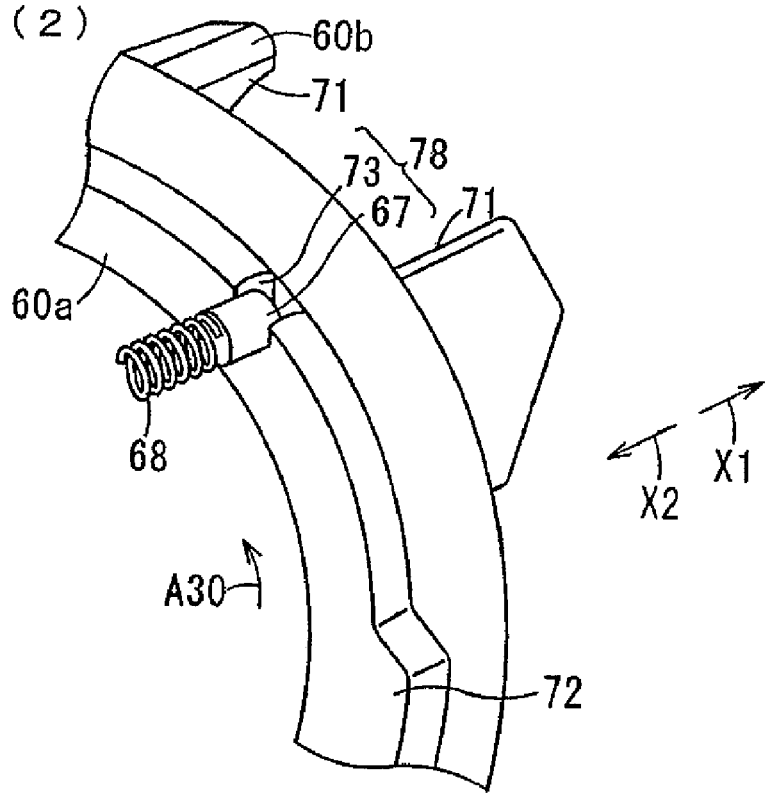
Figure 10:
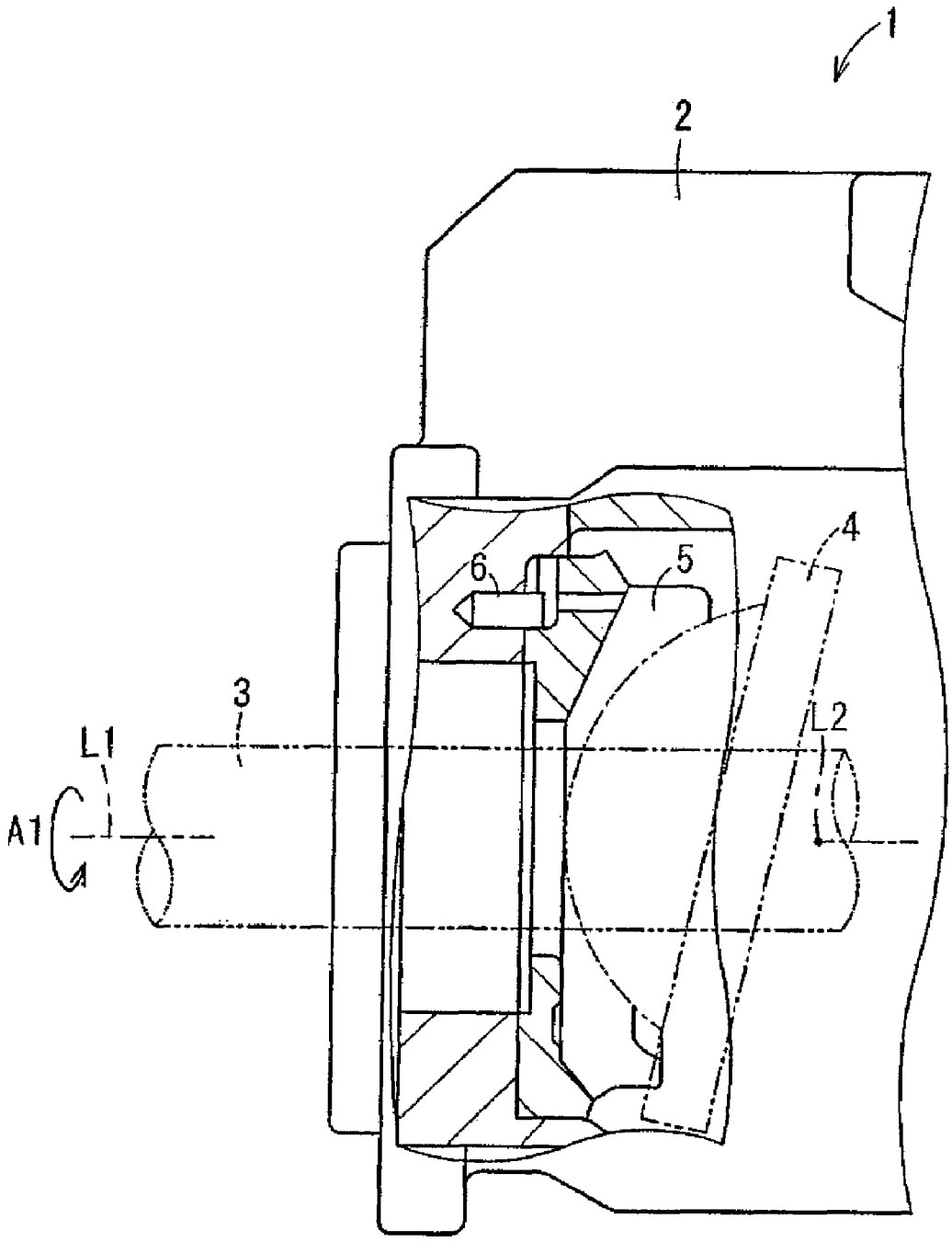
FIG. 10 is an enlarged cross-sectional view of a part of a piston pump 1 according to the first prior art.
Figure 11:
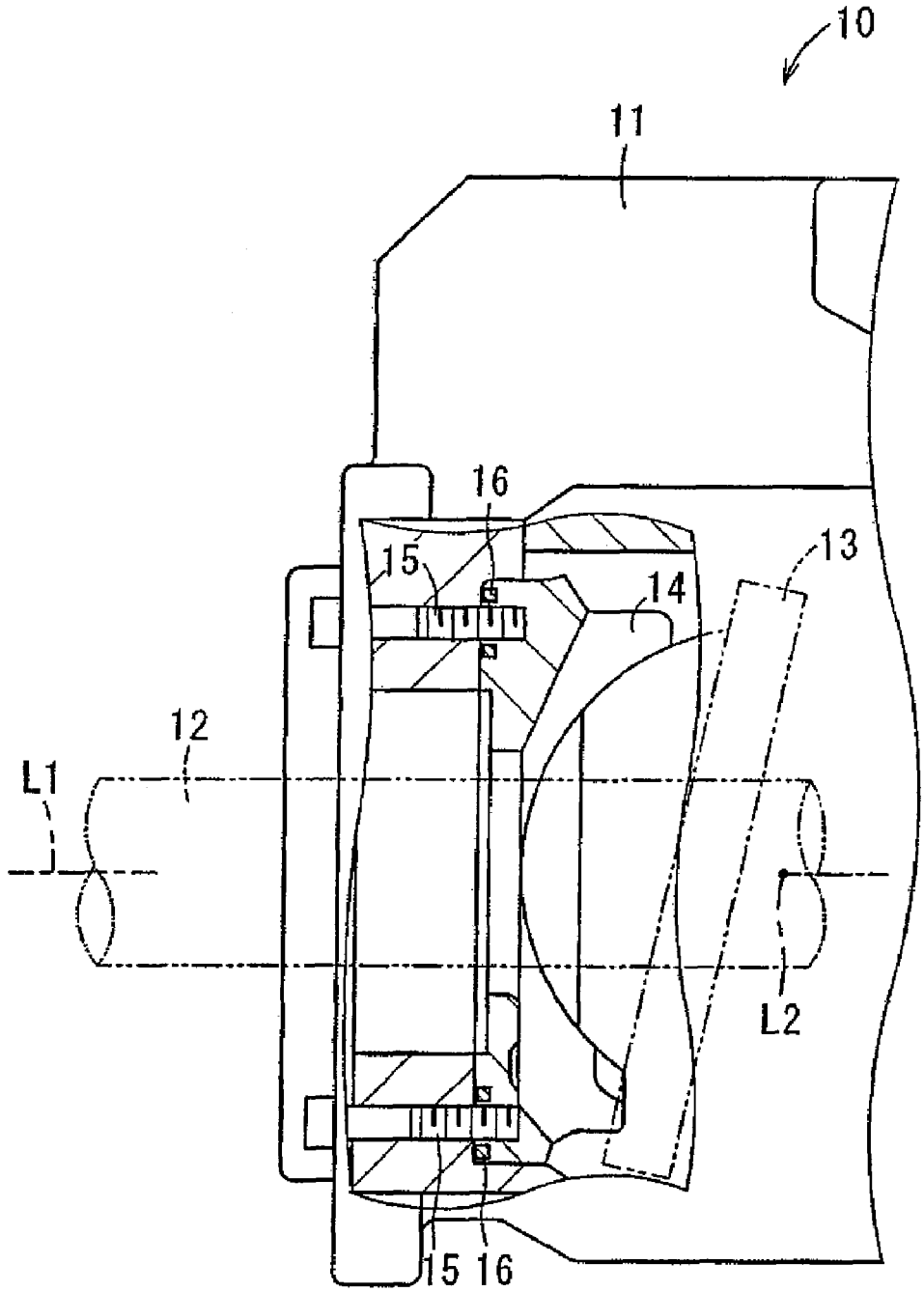
FIG. 11 is an enlarged cross-sectional view of a part of a piston pump according to the second prior art.

FIG. 9 shows views for explaining a process of fitting the pin member 67 in the pin fit hole 73. FIG. 9(1) is a view showing that the pin member 67 does not yet fit in the pin fit hole 73, and FIG. 9(2) is a view showing that the pin member 67 has fitted in the pin fit hole 73. For easier comprehension, FIG. 9 shows only the pin member 67 and the elastic member 68 provided on the front cover 26*b*, and the front cover 26*b* is omitted. A pair of engaging pawl portions 72 are inserted from the insertion openings 64 of the front cover 26*b*, and the swash plate support 60 fits in the attachment hole 62 and is placed at such an attachment preparing position that the engaging pawl portion 73 and the engaging portion 63 do not engage with each other. At this time, the pin member 67 is pushed back by the swash plate support 60 so that the swash plate support 60 fits in the attachment hole 62, and as shown in FIG. 9(1), the contact surface portion 60*b* contacts the bottom portion 65. In a state where the pin member 67 is pressed, it is placed so as to contact the contact surface portion 60*b*, as shown by a chain double-dashed line in FIG. 7. When the swash plate support 60 placed at the attachment preparing position is rotated in the first circumferential direction A30, the engaging pawl portion 72 fits in the engaging groove portion 66 and engages with the engaging portion 63. When the swash plate support 60 is further rotated in the first circumferential direction A30, it is placed at such an attachment completing position that the pin member 67 faces the pin fit hole 73 while the engaging pawl portion 72 is kept engaged with the engaging portion 63. The attachment preparing position and the attachment completing position shift from each other at an angle θ1 in the first circumferential direction A30 and the second circumferential direction A35. The angle θ1 is in such an angular range that the swash plate support 60 can be rotated around the rotational axis with one hand. The angle θ1 is preferably not less than 10 degrees and not more than 90 degrees, and is approximately 45 degrees in the present embodiment. However, the range of the angle θ1 is not limited to the above range, and may be $0<\theta 1<360$. The pin member 67 placed at the attachment completing position is pushed out in the X1 direction by the elastic member 68, is displaced from a non-engagement position where the pin member 67 does not engage with the pin fit hole 73 to an engagement position where the pin member 67 engages with the pin fit hole 73, and fits in the pin fit hole 73. Thus, the swash plate support 60 is attached to the front cover 26*b*.

At the attachment completing position, a pair of engaging pawl portions 72 are placed at positions shifting from a pair of insertion openings 64 at the angle θ1 in the second circumferential direction A35. Therefore, the pin member 67 slides at the angle θ1 from a position where the pin member 67 contacts the contact surface portion 60*b* at the attachment preparing position to a position (shown by a dashed line in FIG. 7) where the pin member 67 contacts the contact surface portion 60*b* at the attachment completing position.

In the case of causing the pin member 67 to withdraw, the rod member is inserted into the through hole 74 and pushes back the pin member 67, so that the pin member 67 withdraws from the pin fit hole 73. In a state where the pin member withdraws from the pin fit hole 73, and the swash plate support 60 is rotated from the engagement position to the non-engagement position in the second circumferential direction A35, the engaging pawl portion 72 can disengage from the engaging groove portion 66. When the disengaged engaging pawl portion 72 is inserted through the insertion opening 64, the swash plate support 60 can be detached from the attachment hole 62. Thus, by rotating the swash plate support 60 from the engagement position to the non-engagement position in the second circumferential direction A35, the swash plate support 60 can be detached from the attachment hole 62. At the attachment preparing position or the attachment completing position, the swash plate support 60 can be rotated in the first circumferential direction A30 and the second circumferential direction A35 which are around the rotational axis.

Hereinafter, effects of the piston pump 20 thus constructed will be explained. In accordance with the piston pump 20 of the present embodiment, the swash plate support 60 can be rotated with respect to the casing 26 from the attachment preparing position to the attachment completing position in the first circumferential direction A30. The swash plate support 60 placed at the attachment preparing position can be displaced with respect to the casing 26 in the X1 and X2 directions. The swash plate support 60 placed at the attachment completing position supports the swash plate 25, is prevented from being displaced with respect to the casing 26 in the X1 and X2 directions by the axial direction displacement preventing device, and is attached to the casing 26. Therefore, when the swash plate support 60 is rotated so as to be placed at the attachment completing position, the unstably fixed state of the swash plate support 60 with respect to the casing 26 in the X1 and X2 directions, for example, unstably fixed state in the X1 and X2 directions due to vibrations and contacts of a drive shaft, is suppressed. Thus, the occurrence of problems, such as damages to internal parts such as the pressing member 51, the piston 23 and the cylinder block 22 due to the unstably fixed state of the swash plate support 60 with respect to the casing 26 is suppressed. Moreover, only by causing the swash plate support 60 to rotate from the attachment preparing position to the attachment completing position in the first circumferential direction A30, the swash plate support 60 can be attached to the casing 26, and only by causing the swash plate support 60 to rotate from the attachment completing position to the attachment preparing position in the second circumferential direction A35, the swash plate support 60 can be set to be detachable from the casing 26. Therefore, the swash plate support 60 can be attached to and detached from the casing 26 more easily than the second prior art. Further, unlike the second prior art, it is not necessary to cause the bolt 15 to penetrate through the casing 11, and the leakage of fluid, such as oil, from a portion where the attachment structure of the swash plate support 60 is used is prevented without adopting a sealing structure.

In accordance with the piston pump 20 of the present embodiment, a pair of engaging portions 63 provided on the casing 26 can engage with the engaging pawl portions 72 provided on the swash plate support 60. In the state where the swash plate support 60 is placed at the attachment preparing position, the engaging pawl portion 72 does not engage with the engaging portion 63, so that the swash plate support 60 can be detached from the casing 26. In the state where the swash plate support 60 is placed at the attachment completing position, the engaging pawl portion 72 engages with the engaging portion 63, so that the swash plate support 60 is prevented from being displaced with respect to the casing 26 in the X1 and X2 directions. With this, it is possible to realize such an attachment structure of the swash plate support 60 that the unstably fixed state of the swash plate support 60 with respect to the casing 26 in the X1 and X2 directions can be suppressed, and the swash plate support 60 can be attached to the casing 26 by a simple operation of causing the swash plate support 60 to rotate in the first circumferential direction A30.

Moreover, in accordance with the piston pump 20 of the present embodiment, in the state where the swash plate support 60 is placed at the attachment completing position, the swash plate support 60 is attached to the casing 26 so as to be prevented by the rotation preventing device 78 from being rotated with respect to the casing 26 in the first circumferential direction A30 and the second circumferential direction A35. Therefore, when the swash plate support 60 is rotated so as to be placed at the attachment completing position and attached to the casing 26, the unstably fixed state of the swash plate support 60 with respect to the casing 26 around the rotational axis L20, for example, unstably fixed state around the rotational axis L20 due to vibrations, is suppressed. Thus, the occurrence of problems, such as damages to internal parts such as the pressing member 51, the piston 23 and the cylinder block 22, due to the unstably fixed state of the swash plate support 60 with respect to the casing 26 is suppressed. Moreover, only by causing the swash plate support 60 to rotate from the attachment preparing position to the attachment completing position in the first circumferential direction A30, the swash plate support 60 can be attached to the casing 26, and only by causing the swash plate support 60 to rotate from the attachment completing position to the attachment preparing position in the second circumferential direction A35, the swash plate support 60 can be set to be detachable from the casing 26. Therefore, the swash plate support 60 can be attached to and detached from the casing 26 more easily than the second prior art. With this, it is possible to facilitate the attaching and detaching of the swash plate support 60, that is, avoid the trouble of having to attach and detach the swash plate support 60), and suppress the unstably fixed state.

In accordance with the piston pump 20 of the present embodiment, the pin fit hole 73 provided on the swash plate support 60 can engage with the pin member 67 provided on the casing 26. In the state where the swash plate support 60 is placed at the attachment completing position, the pin member 67 can be displaced between the non-engagement position where the pin member 67 does not engage with the pin fit hole 73 and the engagement position where the pin member 67 engages with the pin fit hole 73. Therefore, by causing the pin member 67 to be displaced so as to be placed at the engagement position, the displacement of the swash plate support 60 with respect to the casing 26 around the rotational axis L20 is prevented, and by causing the pin member 67 to be displaced so as to be placed at the non-engagement position, the displacement of the swash plate support 60 with respect to the casing 26 around the rotational axis L20 is allowed. With this, it is possible to realize such an attachment structure of the swash plate support 60 that the unstably fixed state of the swash plate support 60 with respect to the casing 26 around the rotational axis L20 can be suppressed, and the swash plate support 60 can be easily attached to the casing 26 by a simple operation of causing the swash plate support 60 to rotate in the first circumferential direction A30. Moreover, by causing the pin member 67 to engage with the pin fit hole 73, the positioning of the swash plate support 60 with respect to the casing 26 can be carried out.

Moreover, in the piston pump 20 of the present embodiment, the pin member 67 is elastically pressed by the elastic member 68 in the X1 direction from the non-engagement position to the engagement position. Therefore, when the swash plate support 60 is placed at the attachment completing position, the pin member 67 is elastically pressed so as to be displaced from the non-engagement position to the engagement position, and realizes engagement. Thus, only by causing the swash plate support 60 to be rotated so as to be placed at the attachment completing position, the pin member 67 can engage with the pin fit hole 73, and the swash plate support 60 can be easily attached to the casing 26. Moreover, since the pin member 67 is elastically pressed in the X1 direction, the withdrawing of the pin member 67 from the engagement position to the non-engagement position is prevented, and the rotating of the swash plate support 60 from the attachment completing position to the attachment preparing position is prevented. Therefore, the displacements of the swash plate support 60 with respect to the casing 26 in the X1 direction, in the X2 direction and around the rotational axis L2 are prevented, and the unstably fixed state is suppressed surely. Moreover, by pressing the pin member 67, placed at the engagement position, in the X2 direction, the pin member 67 can be displaced from the engagement position to the non-engagement position. With this, the swash plate support 60 can be rotated from the attachment completing position to the attachment preparing position, and the swash plate support 60 can be set to be detachable. Thus, it is possible to change from a state in which the swash plate support 60 is attached to the casing 26 to a state in which the swash plate support 60 is easily detachable. With this, it is possible to facilitate the attaching and detaching of the swash plate support 60, that is, avoid the trouble of having to attach and detach the swash plate support 60, and suppress the unstably fixed state.

In accordance with the piston pump 20 of the present embodiment, the attachment structure of the swash plate support 60 is used. With this, it is possible to realize the piston pump 20 in which the unstably fixed state of the swash plate support 60 is suppressed.

In the piston pump 20 of the present embodiment, the attachment preparing position and the attachment completing position shift from each other by the angle θ1. The angle θ1 is set within such an angular range that a palm can be displaced around an arm. Therefore, only by holding the swash plate support 60 placed at the attachment preparing position and rotating it once at the angle θ1 in the first circumferential direction A30, a user can place the swash plate support 60 at the attachment completing position, and attach it easily.

In accordance with the piston pump of the present embodiment, the through hole 74 is formed at a position shifting from the center axis L30 of the pin member 67 which fits in the pin fit hole 73. Specifically, the through hole 74 is formed at a position shifting from the air hole 69. With this, it becomes possible to prevent the rod member, which is inserted through the through hole 74, from getting into the air hole 69 and not being able to press the pin member 67, and the rod member can push the pin member 67 surely and cause the pin member 67 to withdraw from the pin fit hole 73. Thus, the trouble of withdrawing is avoidable by forming the through hole 74 at a position shifting from the air hole 69.

The above-described embodiments are just exemplifications of the present invention, and the constructions may be modified within the scope of the present invention. For example, although two engaging pawl portions 72 are provided on the swash plate support 60, three or more engaging pawl portions 72 may be provided. For example, if two additional engaging pawl portions are provided substantially in parallel with an axis orthogonal to the rotational axis L20 and the tilt axis L2, it is possible to suppress tilting around an axis substantially in parallel with the tilt axis L2. At this time, the insertion openings 64, the number of which is equal to the number of the engaging pawl portions 72, are formed. However, the number of the insertion openings 64 formed is not limited to the same number as the engaging pawl portions 72, and may be equal to or larger than the number of the engaging pawl portions 72. Moreover, the pin member 67 is not limited to the parallel pin, and may be a tapered pin, and the pin member 67 may be applied to not only pumps but also motors. Further, in the above-described embodiments, the cylinder block 22 rotates in only one direction, however it may rotate in both forward and reverse directions. Moreover, in the present embodiments, the axis of the rotational shaft 27 and the axis of the cylinder block 22 are provided coaxially. However, the present embodiments are not limited to this, and these axes may not be provided coaxially, like a bent axis type hydraulic pump in which the above two axes are provided at different positions. The hydraulic apparatus may be constructed so as to be operated by a fluid other than the hydraulic oil, such as operating water. Moreover, the hydraulic apparatus may be constructed so as to be used with apparatuses other than industrial machinery and construction machinery, and in vehicles.

In the present embodiment, the swash plate support 60 is rotated in the first circumferential direction A30 to cause the engaging pawl portion 72 to fit in the engaging groove portion 66 and engage with the engaging portion 63, and the swash plate support 60 is further rotated in the first circumferential direction A30, thereby attaching the swash plate support 60 to the casing 26. However, the present embodiment is not limited to this, and the swash plate support may be rotated in the second circumferential direction A35 to cause the engaging pawl portion 72 to fit in the engaging groove portion 66 and engage with the engaging portion 63, and the swash plate support 60 may be further rotated in the second circumferential direction A35, thereby attaching the swash plate support 60 to the casing 26. That is, the swash plate support 60 may be rotated in the first circumferential direction A30 or the second circumferential direction A35 to cause the engaging pawl portion 72 to fit in the engaging groove portion 66 and engage with the engaging portion 63, thereby attaching the swash plate support 60 to the casing 26. The same effects as above can be obtained regardless of whether the rotation direction when attaching is the first circumferential direction A30 or the second circumferential direction A35.

Moreover, in the present embodiment, the pin member 67 is provided on the casing 26. However, the present embodiment is not limited to this, and the pin member 67 may be provided on the swash plate support 60.

The invention claimed is:

1. An attachment structure of a swash plate support, comprising:

a casing accommodating a cylinder block which is provided so as to be rotatable around a rotational axis and includes a plurality of piston chambers in which a plurality of pistons, which extend and retract in accordance with a rotation of the cylinder block, are fitted; and a swash plate which supports the pistons;

the swash plate support being provided on the casing so as to be rotatable around the rotational axis between an attachment preparing position and an attachment completing position, for supporting the swash plate at the attachment completing position; and an axial direction displacement preventing device for, in a state where the swash plate support is placed at the attachment preparing position, allowing the swash plate support to be displaced with respect to the casing in an axial direction along the rotational axis, and in a state where the swash plate support is placed at the attachment completing position, preventing the swash plate support from being displaced with respect to the casing in the axial direction along the rotational axis.

2. The attachment structure according to claim 1, wherein the axial direction displacement preventing device includes:

a first engaging portion provided on the casing; and a second engaging portion which is provided on the swash plate support, does not engage with the first engaging portion in a state where the swash plate support is placed at the attachment preparing position, and engages with the first engaging portion in a state where the swash plate support is placed at the attachment completing position.

3. The attachment structure according to claim 1, further comprising a rotation preventing device for, in a state where the swash plate support is placed at the attachment completing position, preventing the swash plate support from rotating around the rotational axis with respect to the casing.

4. The attachment structure according to claim 3, wherein the rotation preventing device includes:

an engagement hole provided on one of the casing and the swash plate support;

a pin member which is provided on the other of the casing and the swash plate support, and is displaceable between a non-engagement position where the pin member does not engage with the engagement hole and an engagement position where the pin member engages with the engagement hole in a state where the swash plate support is placed at the attachment completing position; and a spring force generating device for elastically pressing the pin member in an engagement direction that is a direction from the non-engagement position to the engagement position.

5. A hydraulic apparatus, comprising:

the attachment structure according to claim 1.

* * * * *